US006755715B2

(12) United States Patent
Wong

(10) Patent No.: US 6,755,715 B2
(45) Date of Patent: Jun. 29, 2004

(54) DYNAMIC TOY DEVICE

(76) Inventor: Yin Fong Wong, Unit A, 1/FL. Ka Shun House 14-16 Jordan Road, Kowloon, Hong Kong (CN)

( * ) Notice: Subject to any disclaimer, the term of this patent is extended or adjusted under 35 U.S.C. 154(b) by 0 days.

(21) Appl. No.: 10/428,465

(22) Filed: May 2, 2003

(65) Prior Publication Data

US 2004/0097165 A1 May 20, 2004

(30) Foreign Application Priority Data

Nov. 18, 2002 (CN) ..... 02151979 A

(51) Int. Cl.[7] ..... A63H 3/36

(52) U.S. Cl. ..... 446/320; 40/610; 446/484

(58) Field of Search ..... 446/242, 397, 446/175, 265, 404, 484, 489, 320, 236; 40/610, 410, 470, 466, 538, 540, 463; 74/89.22; 403/109.7, 109.1

(56) References Cited

U.S. PATENT DOCUMENTS 2,663,285 A * 12/1953 Johnston et al.
2,874,496 A * 2/1959 Rakes
6,247,991 B1 * 6/2001 Chen ..... 446/242
6,422,915 B1 * 7/2002 Chen ..... 446/242

* cited by examiner

*Primary Examiner*—Jacob K. Ackun
*Assistant Examiner*—Jamila O Williams
(74) *Attorney, Agent, or Firm*—Michael Diaz

(57) ABSTRACT

This invention relates to a dynamic toy device, which can extend and shrink vertically, turn horizontally, and can be used as a framework of a Christmas tree model. It includes a bottom basin, a drive part in the bottom basin, and a dynamic part on the drive part. The dynamic part includes an inner sleeve group in the center and an outer sleeve group outside the inner sleeve group. The outer sleeve group is composed of several outer sleeves coupling one another. A circle protruding inward is set on the inner side at the top of the outer sleeve. A circle protrudes outwardly and is positioned at the outer side at the bottom of the outer sleeve. On the side of the circle at the top of the outer sleeve, there is a protruding block, while on the outer side of the outer sleeve, there is positioned a rising groove of a curve shape. The block on the outside outer sleeve lies in the groove on the abutting inside outer sleeve. Each part of the dynamic part of the device forms its own turning rules, thus the turnings become diversified, and the device provides entertainment to a viewer.

10 Claims, 5 Drawing Sheets

DYNAMIC TOY DEVICE

BACKGROUND OF THE INVENTION

1. Field of the Invention

This invention relates to a toy device, and more particularly, to a dynamic toy device capable of moving up and down and rotate flatly, as well as utilized upon a Christmas tree framework.

2. Description of the Related Art

U.S. Pat. No. 6,247,991 disclosed a kind of turning foldaway toy device. The foldaway part includes a set of front-to-end inner sleeves and a set of front-to-end outer sleeves. The outer sleeve is used for bearing the weight of the ornament, such as a Christmas tree model ornament. Every two abutting outer sleeves depend on two corresponding straight protruding lines for realizing a level directional location. When a lower sleeve turns, the straight protruding lines may pass the turning moment to the higher sleeves. Thus each outer sleeve may realize a harmonious turning of high consistency. However, this kind of turning is rather rudimentary, which can only bring people very limited delight. In addition, this kind of toy device depends on a spiral spring for both inner and outer sleeves to ascend and descend, and a specific spring axis and a motor are equipped for tightening and releasing the spring. Also, in order to realize the level turning of both the inner and outer sleeves, a motor and a set of drive gears are required, thereby providing a very complicated device structure.

U.S. Pat. No. 6,422,915 also discloses a kind of turning foldaway toy device. In a similar manner as discussed above, this disclosed device can also only conduct synchronous and consistent turning. The drive needed for an up-down movement and level turning is provided by the same motor and gear case. Although, its drive structure is more compact than that of U.S. Pat. No. 6,247,991, this device is also not economical to build. After the drive is transmitted to the central gear by the drive gear, the central gear passes the drive to three small gears, which transmits the drive to a peripheral large gear. Therefore, there are too many transmission times, which not only increases the production cost, but also reduces the dependability of transmission. In addition, the large gear adopts an internal gear structure, which increases the processing cost in comparison to an external gear.

SUMMARY OF THE INVENTION

The object of the present invention is to provide a dynamic toy device, which only needs a drive system for realizing a vertical movement and turning of the dynamic part, so as to reduce the cost. In addition, each part of it, upper or lower, turns as per its own rules so as to form diversified turns, thereby providing more fun to a viewer of the toy device.

Briefly, and in accordance with the foregoing, the present invention discloses a dynamic toy device, including a bottom basin, a drive part in the bottom basin, and a dynamic part on the drive part. The dynamic part includes an inner sleeve group in the center as well as an outer sleeve group outside the inner sleeve group. The outer sleeve group is composed of several outer sleeves coupling one another. The inner side of the top of the outer sleeve includes a circle protruding inside, and on the outer side of the bottom of the outer sleeve is a circle protruding outside. Inside the circle at the top of the outer sleeve is a protruding block. A groove rises in a curve and is positioned at the outer side of the outer sleeve. The protruding block on the outside outer sleeve lies in the groove on the abutting inside outer sleeve.

In the above-mentioned dynamic toy device of this invention, there is a protruding bar and a curve-shaped groove, which may correspond and cooperate with each other between every two abutting outer sleeves. When the outer sleeve rises upwardly and turns flatly with some drive, the rotational speed of each outer sleeve is inconsistent, accordingly the ornament attached on the outer sleeve will also show different turning rules, thus providing a beautiful and attractive dynamic toy device.

BRIEF DESCRIPTION OF THE DRAWINGS

The present invention will become fully understood from the detailed description given herein below illustration only, and thus are not limitative of the present invention, and wherein.

DESCRIPTION OF THE INVENTION

Figure 1:
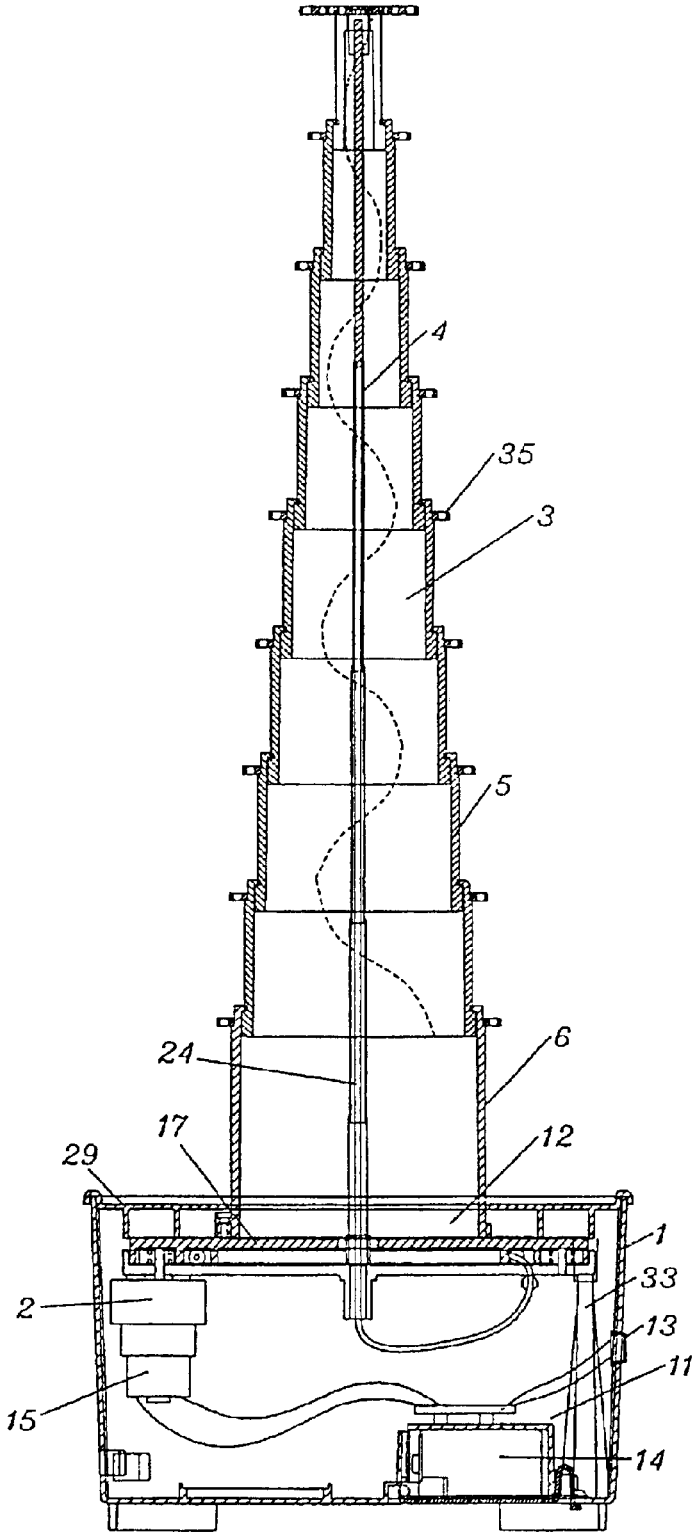
FIG. 1 is the sketch map of this invention when the dynamic part is in a raised state.
Figure 2:
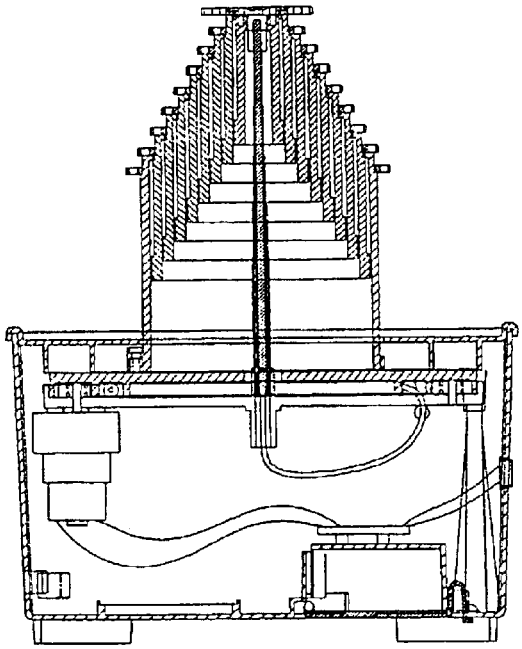
FIG. 2 is the sketch map of this invention when the dynamic part is in a folded state.
Figure 5:
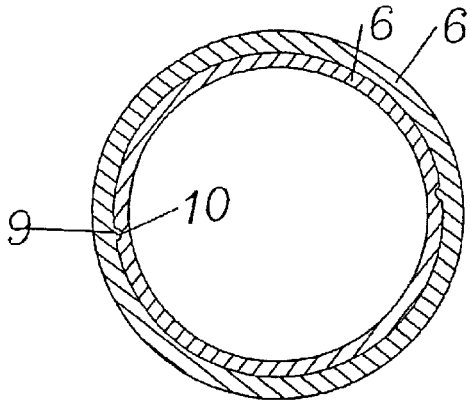
FIG. 5 is the sectional view of two connected outer sleeves.
Figure 6:
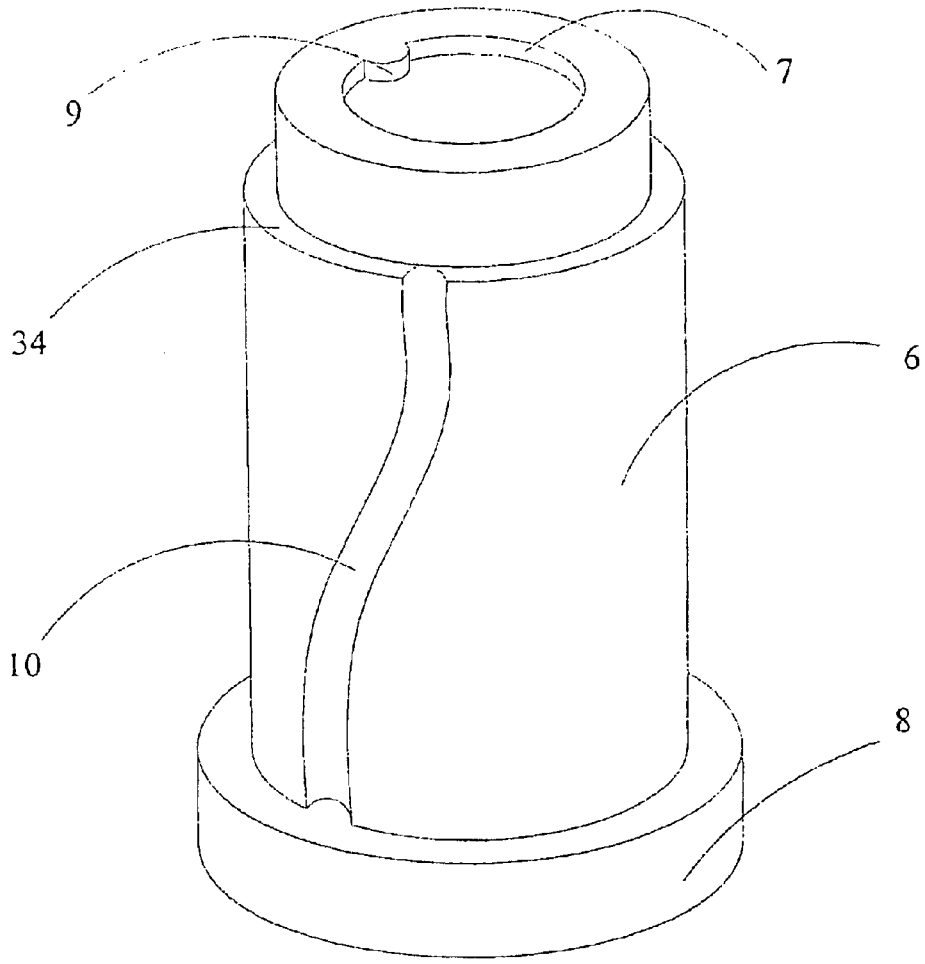
FIG. 6 is the perspective view of one outer sleeve.

As shown in FIG. 1 and FIG. 2, the dynamic toy device of this invention includes a bottom basin 1, a drive part 2 in the bottom basin, and a dynamic part 3 on the drive part 2. Dynamic part 3 includes an inner sleeve group 4 in the center and an outer sleeve group 5 outside the inner sleeve group. Outer sleeve group 5 is composed of several outer sleeves 6 coupling each other. As shown in FIG. 5 and FIG. 6, on the inner side of the top of the outer sleeve 6 is a circle 7 protruding inside, and on the outer side of the bottom of the outer sleeve 6 is a circle 8 protruding outside. A protruding block 9 is set at the side of circle 7, and a groove 10 rising in curve shape is set at the outer side of the outer sleeve 6. Protruding block 9 on the outside outer sleeve lies in the groove 10 on the abutting inside outer sleeve.

Figure 3:
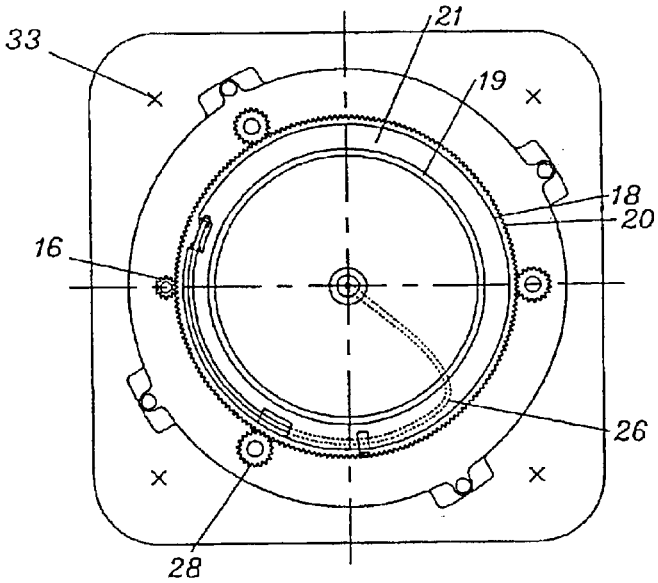
FIG. 3 is the plane view for the drive gear.
Figure 4:
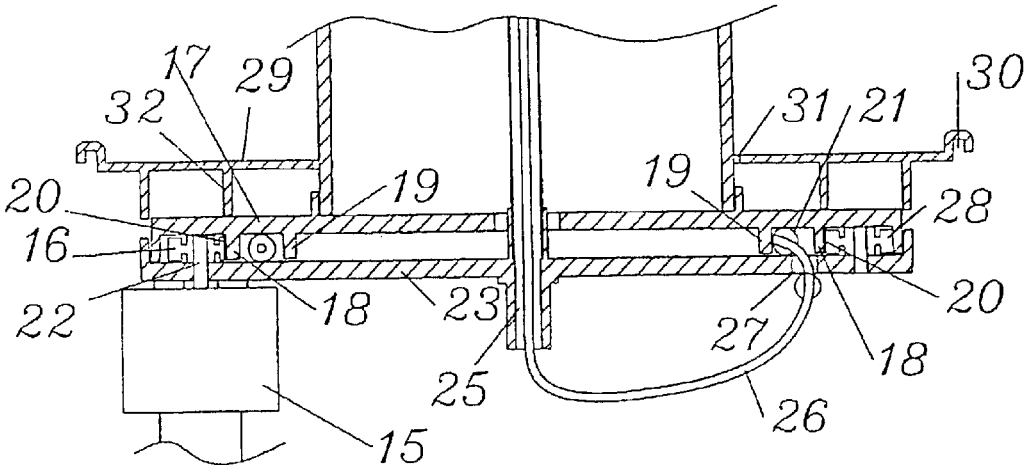
FIG. 4 is the longitudinal sectional view of the drive gear.

As shown in FIG. 1 and FIG. 2, the drive part 2 includes drive source part 11 and transmission part 12. The drive source part includes button 13, electrical source device 14 that connected with button 13 by lead, as well as motor and reducer 15 connected with electrical source device 14 by a lead. As shown in FIG. 3 and FIG. 4, the transmission part 12 includes a drive gear 16 and turnplate 17. The turnplate 17 has two concentric circles protruding downward, i.e., outer circle 18 and inner circle 19. Around the outer circle 18 there are teeth 20 for joggling with the drive gear 16. An annular groove 21 is formed between outer circle 1.8 and inner circle 19. Drive gear 16 connects the output terminal of motor, as well reducer 15, through transmission shaft 22.

As shown in FIG. 1 and FIG. 4, a soleplate 23 for supporting the turnplate 17 is set under the turnplate 17. Inner sleeve group 4 is composed of several inner sleeves 24 coupling each other. The sleeve 24 at the furthest outside of the inner sleeve group is fixed at the center of the turnplate 17. From that sleeve is a channel 25 traversing the turnplate 17 and the supporting soleplate 23.

As shown in FIG. 4, transmission part 12 also includes tightwire 26. One end of tightwire 26 connects with the inner sleeve 24 at the furthest inside through the channel 25 as well the central line of inner sleeve group 4 from under the supporting soleplate 23. The other end of tightwire 26 is fixed in the annular groove 21 through a hole 27 on the supporting soleplate 23 corresponding to the annular groove 21.

As shown in FIG. 3 and FIG. 4, several small gears 28 joggling with teeth 20 are set around the outer circle 18, and axis of small gear 28 is fixed on said supporting soleplate 23.

As shown in FIG. 1 and FIG. 4, the lower end of sleeve 6 at the furthest outside of the outer sleeve group 5 is fixed and connected with the upper surface of said turnplate 17. A cover board 29 is also set on the upper part of the turnplate 17, and an annular groove 30 with downward hatch is set around the cover board 29 for joggling with the upper part of the bottom basin 1. At the central part of cover board 29 there is a round hatch 31 so that both inner and outer sleeve can get through. An annular protruding part 32 is set at the down side of the cover board 29 for locating the turnplate 17. When it turns with the turnplate 17, the end of the protruding part 32 sometimes has slight attrition with the upper surface of the turnplate 17, so as to avoid too much swing of the turnplate 17 in the vertical direction. Small gear 28 is also used for locating the turnplate 17, which can avoid too much level excursion of the turnplate 17 during the turning course.

As shown in FIG. 1 and FIG. 3, fixed supports 33 are set at the four corners of the bottom basin 1. On the top of the fixed support, there is some bolts for connecting with the turnplate 17 and the supporting soleplate 23.

As shown in FIG. 1 and FIG. 6, a ladder 34 is positioned on the outer side at the top of the outer sleeve 6, and an annular deck plate 35 is set on the ladder 34, which can be used for connecting ornaments, such as branches and leaves of Christmas tree, etc.

Figure 7:
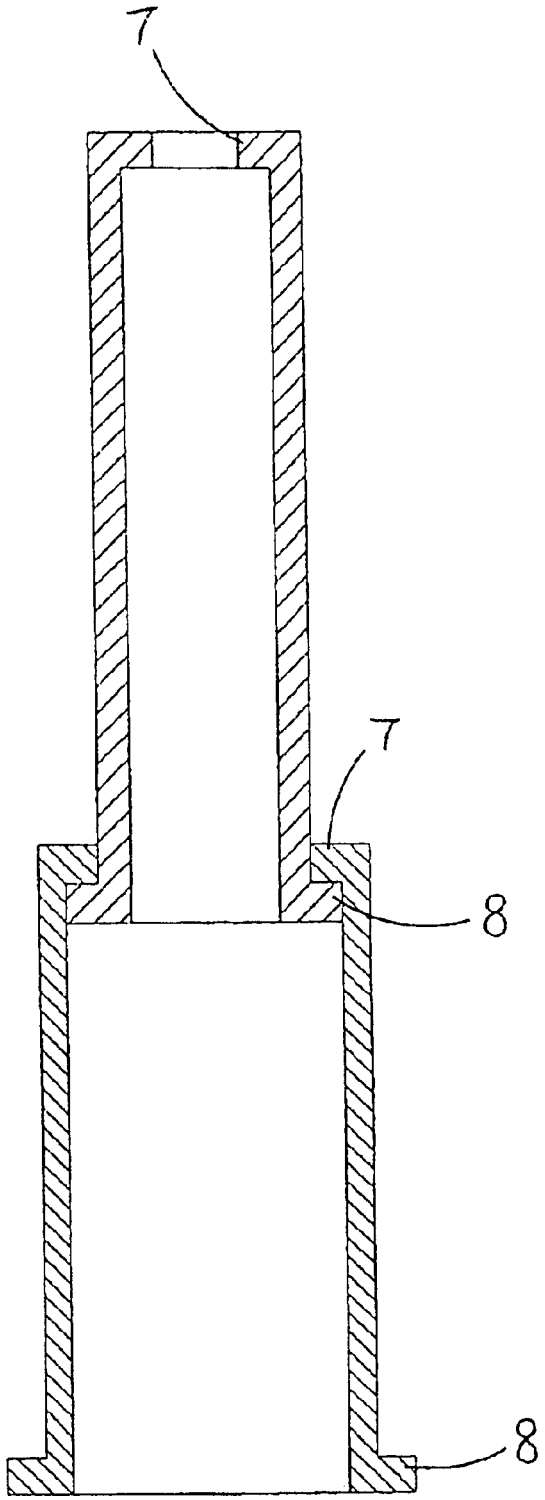
FIG. 7 is the connecting sketch map of two sleeves.

FIG. 7 is the connecting sketch map of two abutting sleeves. This kind of connecting method applies to both the inner sleeve and the outer sleeve. On the inner side at the top of the sleeve there sets a circle 7, which protrudes inward, while on the outer side at the bottom there sets a circle 8, which protrudes outward. The smaller sleeve gets through the top of the bigger sleeve from its lower part, while the circle 8 joins and meets with the circle 7.

In the toy device of this invention, the outer sleeve 6 at the furthest inside of the outer sleeve group connects with the inner sleeve 24 at the furthest inside of the inner sleeve group 4. The electrical source device 14 of this invention can be a battery box or a commutating device that utilizes market power supply. It also includes a circuit or integrated circuit which controls the power supply according to the up-down moving course of the sleeve.

Below is the detailed description for the movement of the dynamic toy device of this invention:

When inner sleeve group 4 and outer sleeve group 5 are in a folded state, the button 13 may be pressed. The electrical source device 14 supplies power for the motor and reducer 15. The motor then starts up, which can drive the drive gear 16 to turn, and drive gear 16 drives turnplate 17 to turn. On the one hand, the turnplate 17 drives the inner sleeve group 4 and outer sleeve group 5 fixed on it to turn flatly. On the other hand, it pushes the tightwire 26 stored in the annular groove out, which will ascend along the channel 25 and push the inner sleeve 24 at the furthest inside ascend upward. When the inner sleeve 24 at the furthest inside protrudes from its abutting inner sleeve, it will drive the abutting sleeve to ascend. This lifting force passes orderly until all the inner sleeves extend completely. At the same time, when the inner sleeve 24 at the furthest inside drives all the inner sleeves to extend, it also drives the outer sleeve 6 at the furthest inside to ascend. Accordingly, the outer sleeve 6 will also drive all the outer sleeves to ascend until all extended, as shown in FIG. 1. When extending upward, both inner and outer sleeves turn flatly driven by the turnplate 17 simultaneously. As at the same time of turning with the turnplate 17, each outer sleeve shall also conduct level turning along the curve groove on the outer side of its abutting outer sleeve, thus the rotational speed of the outer sleeve, which is still extending, is different from that of other outer sleeves, and the ornaments attached on them show diversified turning methods.

After all the inner and outer sleeves are spread, the turning is stopped through appropriate circuit control. By pressing button 13, the turnplate 17 drives the inner and outer sleeves to turn in the reverse direction. Meanwhile, the tightwire 26 is taken back to the annular groove 21, both inner and outer sleeves retract downward pulled by tightwire 26, and folded into the initial state as shown in FIG. 2.

It is thus believed that the operation and construction of the present invention will be apparent from the foregoing description. While the apparatus and method shown and described has been characterized as being preferred, it will be readily apparent that various changes and modifications could be made therein without departing from the scope of the invention as defined in the following claims.

What is claimed is:

1. A dynamic toy device, said dynamic toy device comprising:

a bottom basin;

a drive part in said bottom basin; and a dynamic part on said drive part, said dynamic part having:

an inner sleeve group in a center of said dynamic part; and an outer sleeve group outside the inner sleeve group, said outer sleeve group being composed of a plurality of outer sleeves coupling each other, wherein a first circle protrudes inwardly and is set on an inner surface at the top of each outer sleeve, and a second circle protrudes outwardly and is set on an outer surface at the bottom of each outer sleeve;

wherein said first circle includes a protruding block and a rising groove having a curved shape located on the outer side of said outer sleeve, said protruding block on the outside outer sleeve laying in the groove on an inner surface of an abutting outer sleeve.

2. The dynamic toy device of claim 1, wherein:

said drive part includes a drive source part, said drive source having a button;

a transmission part;

a power supply device connected to the button by a first plurality of leads;

a motor; and a reducer connected to the power supply device by a second plurality of leads.

3. The dynamic toy device of claim 2, wherein said transmission part includes:

a drive gear; and a turnplate, said turnplate having an inner circle and an outer concentric circle protruding downward, wherein said outer circle includes teeth for joggling with said drive gear and an annular groove formed between said outer circle and said inner circle;

whereby said drive gear connects with a plurality of output terminals of said motor and reducer through a transmission shaft.

4. The dynamic toy device of claim 3, wherein:

said turnplate includes a supporting soleplate for supporting said turnplate;

said inner sleeve group is composed of a plurality of inner sleeves coupling one another; and a furthermost outside sleeve of the inner sleeves is fixed at the center of said turnplate, the furthermost outside sleeve having a channel running through said turnplate and supporting soleplate.

5. The dynamic toy device of claim 4, wherein:

said transmission part includes a tightwire having a first end of the tightwire connected with a furthest inner portion of said inner sleeve, the tightwire running through the channel and a central line of said inner sleeve group; and a second end of the tightwire runs through a hole located on said supporting soleplate and is fixed in the annular groove.

6. The dynamic toy device of claim 4, wherein:

a plurality of small gears for joggling with said teeth are positioned at a periphery of said outer circle; and the axises of said small gears are fixed at said supporting soleplate.

7. The dynamic toy device of claim 3, wherein the lower end of said sleeve at the furthest outside of said outer sleeve group is connected and fixed on the upper surface of said turnplate.

8. The dynamic toy device of claim 6, wherein the lower end of a sleeve at the furthest outside of said outer sleeve group is connected and fixed on the upper surface of said turnplate.

9. The dynamic toy device of claim 3, wherein said outer sleeve at the furthest inside of said outer sleeve group is connected to said inner sleeve at the furthest inside of said inner sleeve group.

10. The dynamic toy device of claim 6, wherein said outer sleeve at the furthest inside of said outer sleeve group is connected to said inner sleeve at the furthest inside of said inner sleeve group.

* * * * *